US006305566B1

(12) United States Patent
Pigott et al.

(10) Patent No.: US 6,305,566 B1
(45) Date of Patent: Oct. 23, 2001

(54) CONTAINER FOR FRAGILE ARTICLES

(75) Inventors: Maurice J. Pigott, Winnetka; Brandon L. Pigott, Wilmette; Schuyler F. Pigott, Arlington Heights; Peter S. Pigott, Wilmette; Jerry J. Fan, Vernon Hills, all of IL (US)

(73) Assignee: Nucon Corporation, Deerfield, IL (US)

( * ) Notice: Subject to any disclaimer, the term of this patent is extended or adjusted under 35 U.S.C. 154(b) by 0 days.

(21) Appl. No.: 09/545,390

(22) Filed: Apr. 7, 2000

(51) Int. Cl.[7] ..... B65D 7/00

(52) U.S. Cl. ..... 220/6; 220/1.5; 206/449; 206/521.8

(58) Field of Search ..... 220/6, 1.5; 206/449, 206/561, 521.8, 386

(56) References Cited

U.S. PATENT DOCUMENTS

| | | | | |
|---|---|---|---|---|
| 2,621,807 | | 12/1952 | Rendich . | |
| 2,894,640 | * | 7/1959 | Bigelow | 206/449 X |
| 3,321,864 | * | 5/1967 | Stasiuk | 220/6 X |
| 3,612,637 | * | 10/1971 | Betts | 206/449 X |
| 4,062,467 | | 12/1977 | Friedrich . | |
| 4,287,836 | | 9/1981 | Aoki . | |
| 4,591,065 | | 5/1986 | Foy . | |
| 4,674,647 | * | 6/1987 | Gyenge et al. | 220/6 |
| 4,735,330 | | 4/1988 | Hoss . | |
| 4,890,740 | | 1/1990 | Tabler . | |
| 4,917,255 | | 4/1990 | Foy et al. . | |
| 4,967,927 | | 11/1990 | Reiland et al. . | |
| 5,154,286 | | 10/1992 | Gits . | |
| 5,573,117 | * | 11/1996 | Adams | 206/449 |

FOREIGN PATENT DOCUMENTS

| | | |
|---|---|---|
| 385914A1 | 9/1990 | (EP) . |
| 2272907 | 5/1974 | (FR) . |

* cited by examiner

*Primary Examiner*—Steven Pollard
(74) *Attorney, Agent, or Firm*—Wallenstein & Wagner, Ltd.

(57) ABSTRACT

A container is disclosed having a base, opposed side walls, and a rear wall. The base has an upper surface with a downward slope ($\alpha$) towards the rear wall. The rear wall has a surface which is preferably angled to be perpendicular to the upper surface of the base. Such a configuration permits squared items to be stored within the container on a edge while maintaining full contact along an adjacent edge with the rear wall. The side walls and rear wall are hingedly attached to the base and connected to one another using interlocking connectors along juxtaposed edges. Alternatively, the present invention may include a double sloped base upper surface angled toward a center wall panel. The surfaces on each side of the center wall are preferably sloped to be perpendicular to the upper surface of the adjacent base upper surface. A double-sloped container using at least one center wall panel is also disclosed with similar features to the single-sloped container.

44 Claims, 6 Drawing Sheets

10
β
60
61
62
52
50
28
21
5
22
20
30
42
40

α
24a
24b
24
21
22
20
41
40
23

CONTAINER FOR FRAGILE ARTICLES

TECHNICAL FIELD

The present invention generally relates to containers, and more particularly, to a novel plastic container that is foldable or collapsible and is used for storing, transporting and displaying goods, such as glass panels, windows, door panels, or rectangular boxes.

BACKGROUND OF THE INVENTION

Currently, containers are used for storing and transporting numerous items. Certain fragile items, like door mirrors, windows, glass panes, frames, etc. are difficult to store in such a manner. In particular, these items are generally thin (relatively) rectangular items. If stored on there faces (e.g., the front and back surfaces) and stacked on top of one another, problems can occur. In addition, often times the front and back faces of the objects are not designed to bear any significant weight. For example, twenty stacked mirrors (i.e., stacked on top of one another) can be quite dangerous, both as to the objects themselves and to individuals nearby, as the faces are subjected to substantial loads. For this reason, such items are frequently stored side-by-side, like books on a shelf in a library. In this matter, the load caused primarily of the weight of the object is borne by an edge or side of the object. Thus, doors are transported, stored and displaced on their side edge, namely the bottom surface of the door. The door is transported in much the same way it is oriented in use.

One problem associated with storing, transporting and displaying objects standing on an edge is the absolute need for side walls on the structure supporting, transporting or displaying the object. For example, a pallet supporting twenty mirrors, standing on their side edges will fall over unless either tied tightly together, e.g., encircling the entire group with rope, or supported by side walls attached to the pallet. A four walled bin (pallet with four side walls) will hold the side-by-side objects. Nevertheless, with four walls, it becomes difficult to remove the objects being stored in the bin or on the pallet. To remove a single object, one must lift the object over a significantly high wall. This manipulation can, of course, cause breakage.

For this reason, sometimes three-walled bins are desired. Three walled bins (a pallet with three side walls attached thereto) have many advantages. The items being stored, transported and displayed (again like books on a book shelf) can be easily supported (two side walls take much of the weight bearing loads and the absence of one wall permits both easy viewing of the objects and easy removing of the objects off the pallet supporting them.

Accordingly, there is a need for devices and mechanisms to facilitate and improve upon the safety and improve upon existing systems associated with the storage and transporting of bins.

SUMMARY OF THE INVENTION

The present invention is a collapsible container that includes a base, opposed side walls and a rear wall. The base has an upper surface that slopes downwardly towards the rear wall. The rear wall is further sloped from the vertical. The walls are hinged to the base and can be removed when desired or rotated relative to the base. The hinge permits strong interconnection and minimum risk of separation between the components. The container rests upon a plurality of feet.

The collapsible container is designed for transporting and displaying doors, mirrors, ironing boards, ready-to-assemble (RTA) products, such as furniture and other long carton box packages. Packages can stand on the short ends (side edges) while leaning against the back panel to remain stable. The open front allows easy retrieval of packages without significant lifting over the side panels. Moreover, packages of different sizes and different products can be mixed on the same container. Additionally, packages can be divided up to about a dozen sections to allow for easy assortment and retrieval. There is no stacking of packages, thus avoiding breakage of products. The container can be further used for shipping, storing, and displaying items. In addition, the back and side panels can be folded down to reduce storage and transportation volume when the containers are shipped empty. Fork lifts and hand jacks can be easily used to move the container as four way entry is permitted.

The container is designed for multi-trip uses, thus reducing packaging cost as compared with one trip wood pallets and containers. This results in reduced material and waste handling for wholesalers and retailers compared with one trip boxes.

These and other aspects of the present invention set forth in the appended claims may be realized in accordance with the following disclosure with particular reference to the accompanying drawings.

BRIEF DESCRIPTION OF THE DRAWINGS

In the accompanying drawings forming part of the specification, and in which like numerals are employed to designate like parts throughout the same.

DETAILED DESCRIPTION

Figure 1:
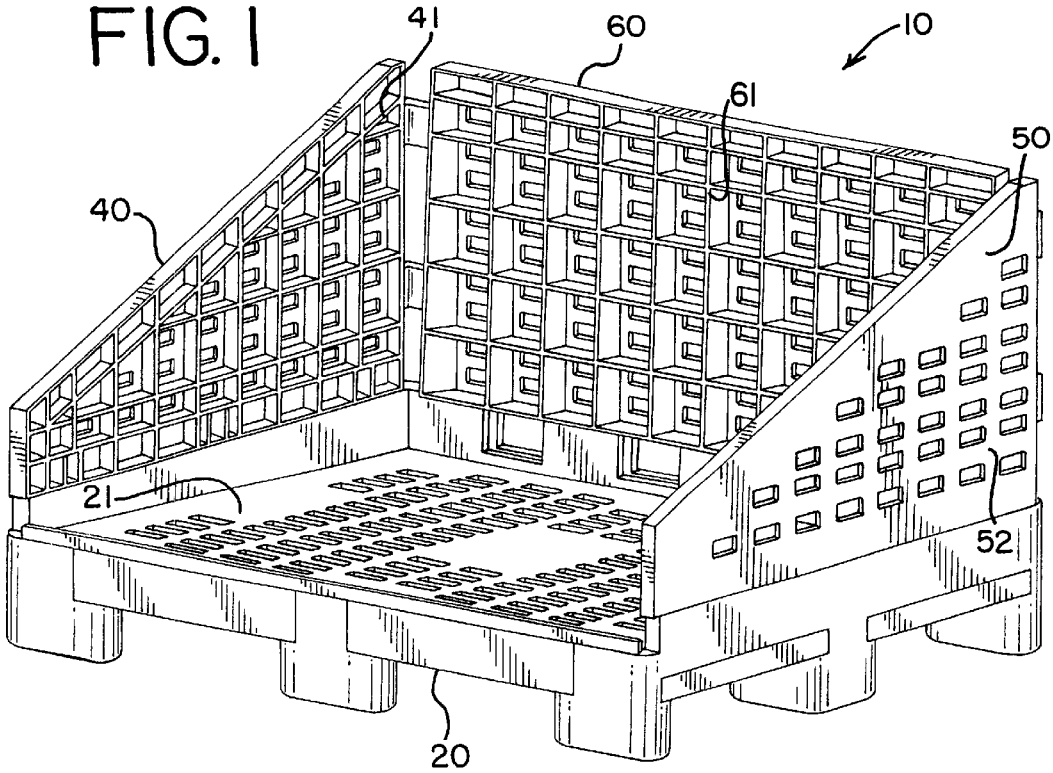
FIG. 1 is a front perspective view of one embodiment of a container made in accordance with the teachings of the present invention.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

Turning to the FIGS. 1–11, one embodiment of a container 10 is shown in its various views. The preferred container 10 has a base pallet 20, two optional side walls 40, 50 and a rear wall 60. The base 20 has an inner (top or upper) surface 21 and an outer (bottom or lower) surface 22. Similarly, each side wall 40, 50 has an inner surface 41, 51 and an outer surface 42, 52. Likewise, the rear wall 60 has inner and outer surfaces 61, 62.

The outer surfaces 42, 52, 62 of the side and end walls 40, 50, 60 and inner surface of the base 20 are substantially planar. The surfaces are, however, not necessarily parallel, as will be explained. The inner surfaces 41, 51, 61 of the walls and outer surface of the base have projecting ribs added to strengthen the members. The construction of these ribs or cells is well known in the art. The walls and base also have holes or openings therein to reduce the weight of the components and the entire assembly. This too is well known in the industry. Feet 30 are integral with the outer surface 22 of the base pallet 20. These feet can be molded with the base as one unified and integral member or attached, such as by sonic welding, with the base. The location and general construction of the feet 30 can be seen in FIG. 2. The feet lift the base off the ground and permit four (4) way entry of forklift tines and hand truck tines in the spaces between the feet.

Figure 3:
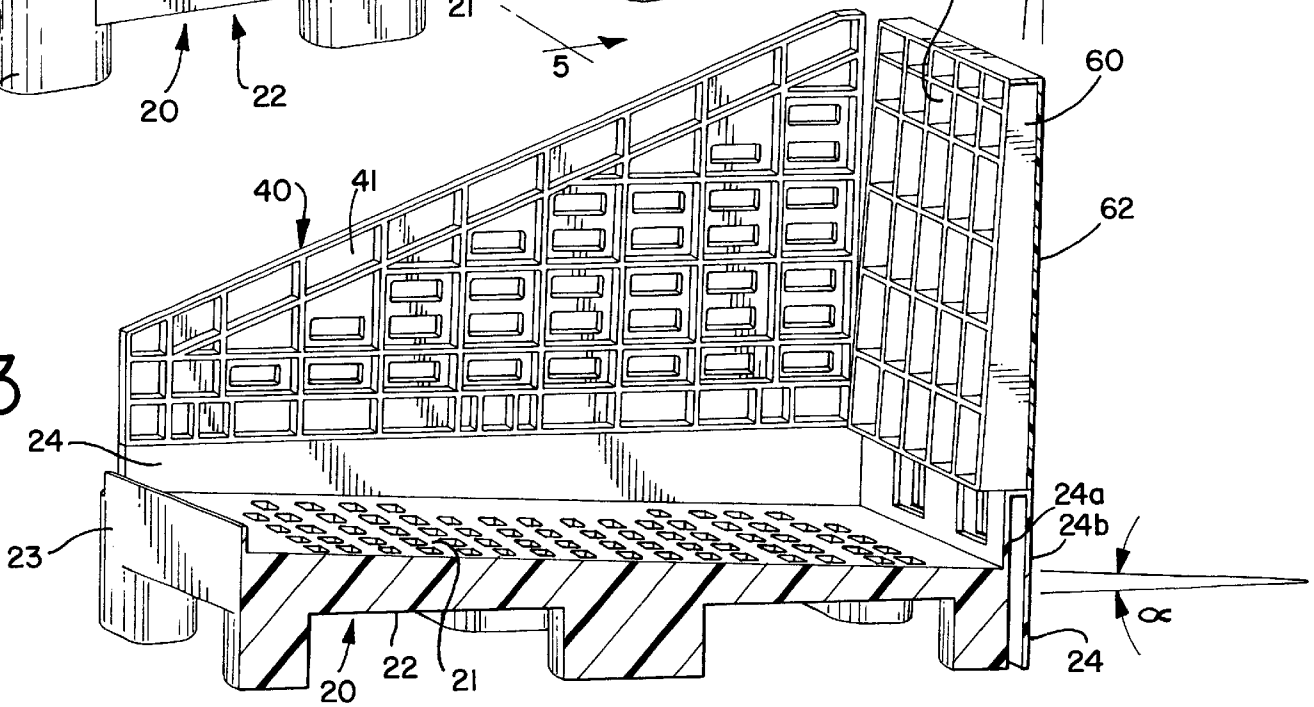
FIG. 3 is a sectional side perspective view of the container.

The specific construction of the base 20 can be best seen in FIG. 3. The base 20 has a substantially flat outer surface 22 that is substantially parallel to the ground when the container 10 rests upon the ground. The inner surface 21 is not parallel to the outer surface 22; rather, the inner surface 21 is sloped or inclined downwardly towards the rear wall 60. In particular, the angle $\alpha$ formed by the imaginary planes formed by extending the existing planes of the inner surface 21 and outer surface 22 of the base 20 is approximately 2.5°. A front lip 23 is constructed it the front of the base 20. Its purpose is to act as a stop or bumper.

Still referring to FIG. 3, the rear wall 60 has a substantially flat outer surface 62 that is substantially perpendicular to the ground when the container 10 rests upon the ground. The inner surface 61 is also sloped or inclined. In particular, the angle $\beta$ formed by the imaginary planes formed by extending the existing planes of the inner surface 61 and outer surface 62 of the rear wall 60 is approximately 2.5°.

The inner surfaces 41, 51 and outer surfaces 42, 52 of the side walls 40, 50 are preferably substantially parallel to one another.

Figure 4:
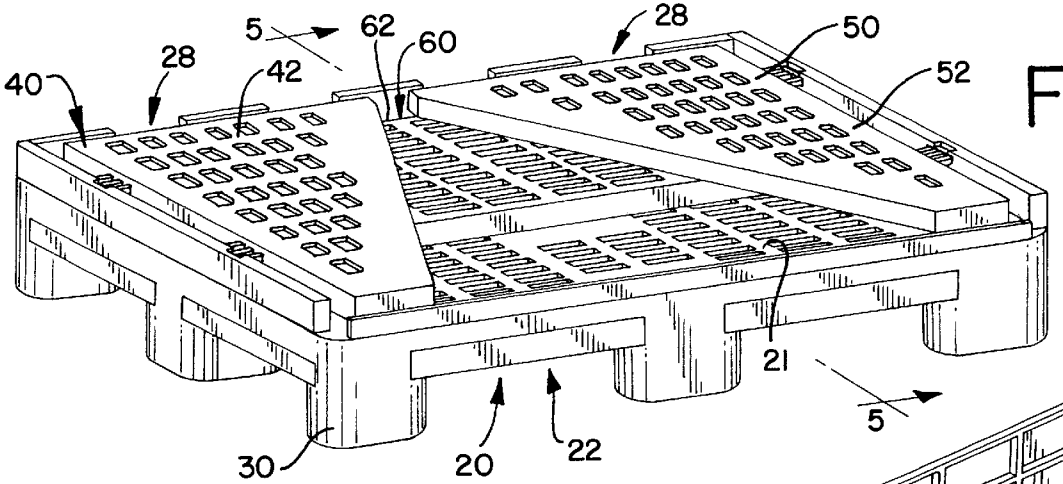
FIG. 4 is a front perspective view of the container in the folded, empty position.
Figure 5:
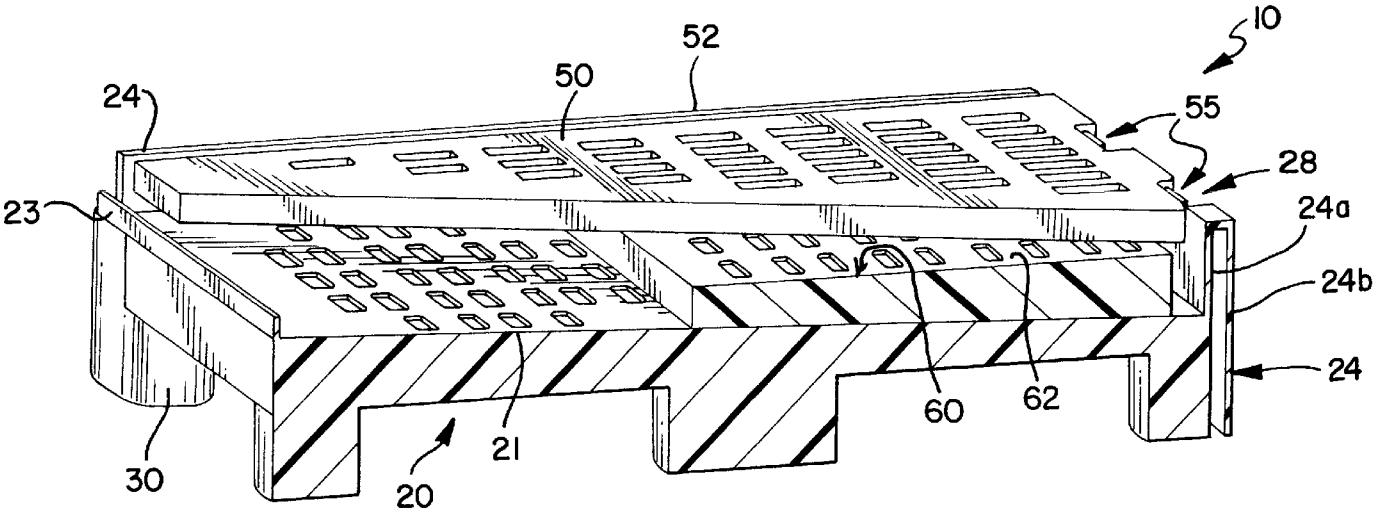
FIG. 5 is an sectional end perspective view of the container in the folded and empty position along line 5—5 in FIG. 4.

The walls 40, 50, 60 are hingedly connected to the base 20. More particularly, each wall is connected to the base by two or more hinges. Additionally, the walls are interconnected. The hinges permit the walls to be upright (FIGS. 1, 2 and 3) or folded (FIGS. 4 and 5). The interconnection between the walls strengthens the walls and distributes the loads between them.

Figure 7:
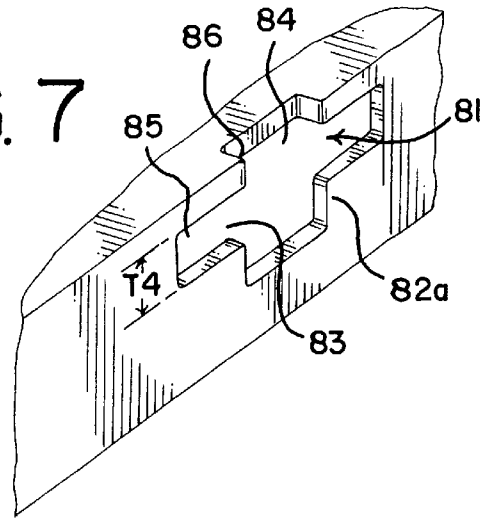
FIG. 7 is top perspective schematic view of the pallet base having a female component for a preferred hinge assembly.
Figure 6:
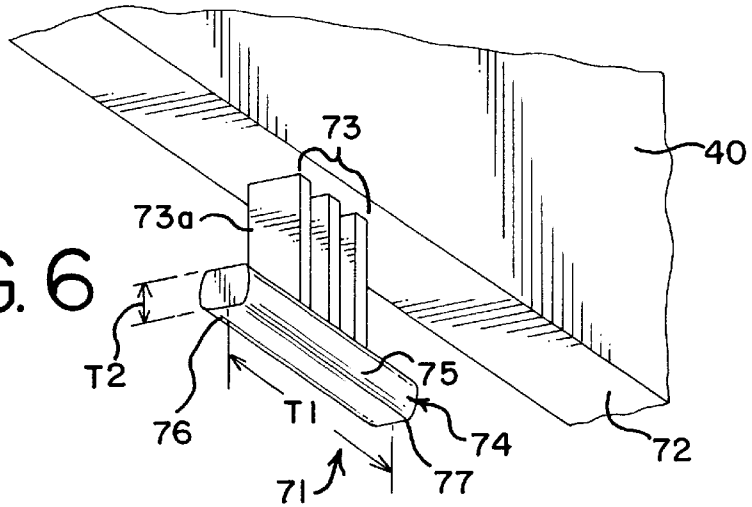
FIG. 6 is bottom perspective schematic view of the side wall panel having a male component for a preferred hinge assembly.

The hinge assembly components 70 shown in FIGS. 6 and 7 are schematic and represent the preferred female and male components of a hinge assembly. The position, orientation, construction and working of these hinges shall now be explained. The side walls 40, 50 and rear wall 60 have spaced apart male connectors 71 projecting from their bottom edges 72. Each of these male connectors 71 is preferably T-shaped, having a body 73 and an arm 74. In the present embodiment of FIG. 6, the body is formed of three parallel elements (73*a*). The arm 74 (the cross member of the T-shaped member at the distal end of the body 73) has a horizontal thickness of T1, a vertical thickness of T2, a leading surface 75, and a trailing surface 76. The leading and trailing surfaces 75, 76 are substantially flat. The side surfaces 77 connecting the leading and trailing surfaces are arcuate.

The base 20 has a girdle 24 projecting inwardly (up) therefrom. The girdle 24 houses the spaced apart female connectors 81 (FIG. 7) that mate with the male connectors 71. The girdle 24 is hollow, formed of two parallel walls 24*a*, 24*b* (FIG. 3). A cross-shaped aperture 83 is cut into the inner parallel wall 24*a* (82*a*, 82*b* in FIGS. 6 and 7). This cross-shaped aperture 83 has a body 84 and cross arm 85. The cross arm 85 has a vertical thickness of T4, which is slightly greater than the thickness of the arm 74 of the male connector 71 (the distance between the leading surface 75 and the trailing surface 76), permitting the arm 74 to slip into the arm 85. The thickness of male connector T1 is slightly less than the distance between the parallel walls 82*a*, 82*b*, permitting the male arm to slide between the parallel walls. However, once the male T-connector is between the parallel walls 82*a*, 82*b*, it cannot slide out as the upper edge 86 prevents movement out of the walls. Yet, the wall (side or rear) having the male connector 71 can rotate relative to the base's girdle having the female connector 81.

The connectors work as follows. Each wall (40, 50, 60) has male connectors 71 projecting downwardly from the bottom edge. The base has corresponding female apertures 81 in the girdle thereof. The male T-shaped connectors are aligned with the female T-shaped apertures. The male arm is moved toward the female arm and inserted. The male connector is then dropped into position. The wall is thus pivoted outwardly and then moved downwardly (in the slot between the parallel walls). While this motion occurs the three walls interlock through a simple finger system.

Figure 2:
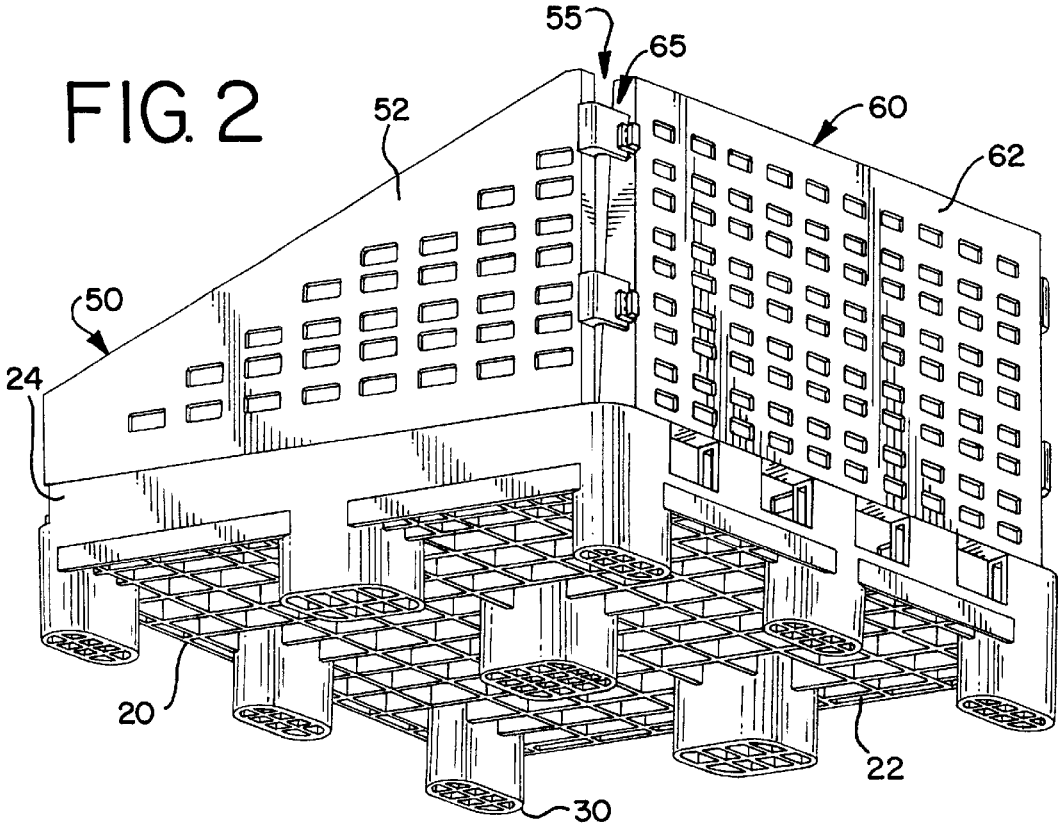
FIG. 2 is a rear perspective view of the container of FIG. 1.
Figure 8:
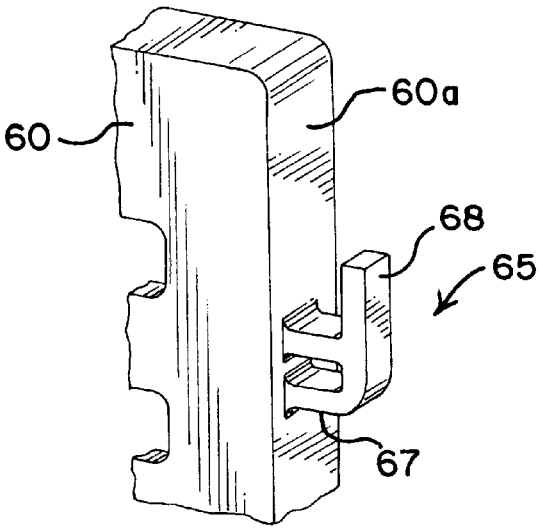
FIG. 8 is a perspective schematic view of one part of an interlocking finger connector attached to the rear wall panel.
Figure 9:
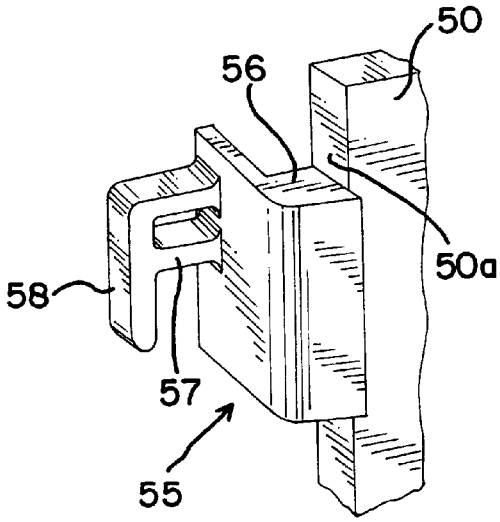
FIG. 9 is a perspective schematic view of another part of an interlocking finger connector attached to the side wall panel.
Figure 10:
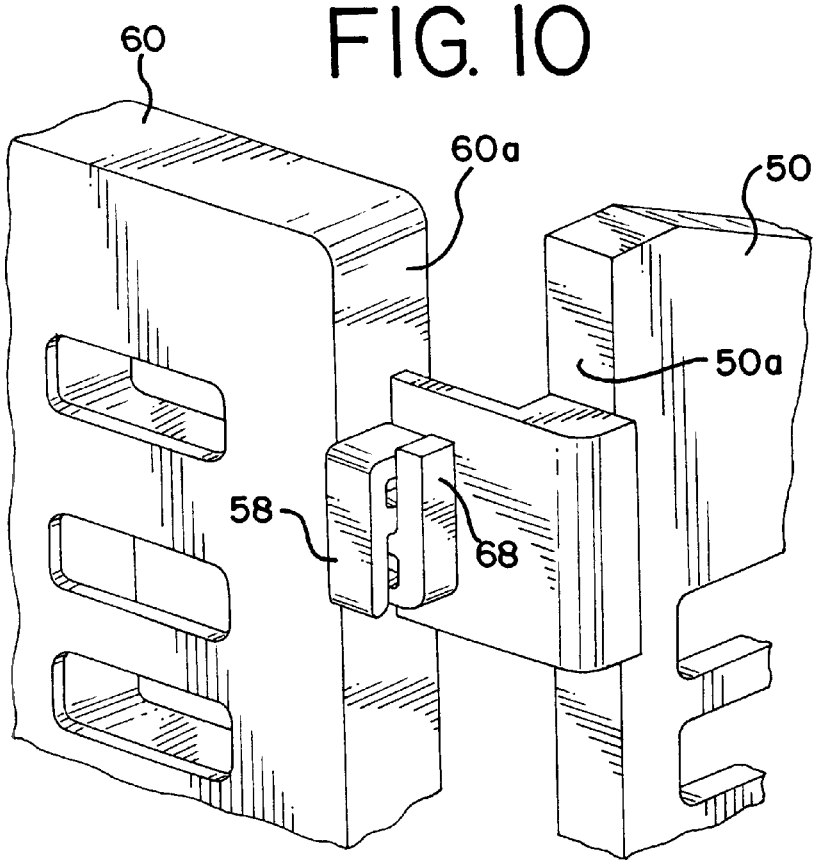
FIG. 10 is a perspective schematic view of the connector of FIGS. 8 and 9 interlocked.

Each wall 40, 50, 60 preferably has at least two connectors 45, 55, 65, as illustrated in FIGS. 1 and 2. Referring to FIGS. 8, 9, and 10 the connector dynamics between the side wall 50 and the rear wall 60 can be more readily understood. While not discussed, the other side wall 40 is constructed similarly to the side wall 50 shown. The side wall 50 has a connector 55 projecting from the rear edge 50*a* of the wall. The connector 55 comprises a extension 56, projection 57 and tip 58. The connector 65 projecting from the side edge 60*a* of the rear wall 60 includes a projection 67 and tip 68. The connectors 55, 65 are capable of interlocking, as illustrated in FIG. 10, when the side wall 50 is lowered onto the base 20 during the attachment of the hinge assembly discussed above. To rotate the interlocked walls 40, 50, they must initially be lifted or raised slightly above the base 20 to allow the connectors 45, 55, 65 to be disconnected. The walls 50, 60 are thus free to rotate relative to the base 20 or be removed from the base 20.

The container 10, once folded, appears as is shown in FIGS. 4 and 5. The top surface of the container is relatively flat with the walls 40, 50 folded downward, seated just below the girdle 24 of the base 20. The girdle 24 has cut-outs 28 therein for seating the connectors 22 of the walls 50.

Figure 11:
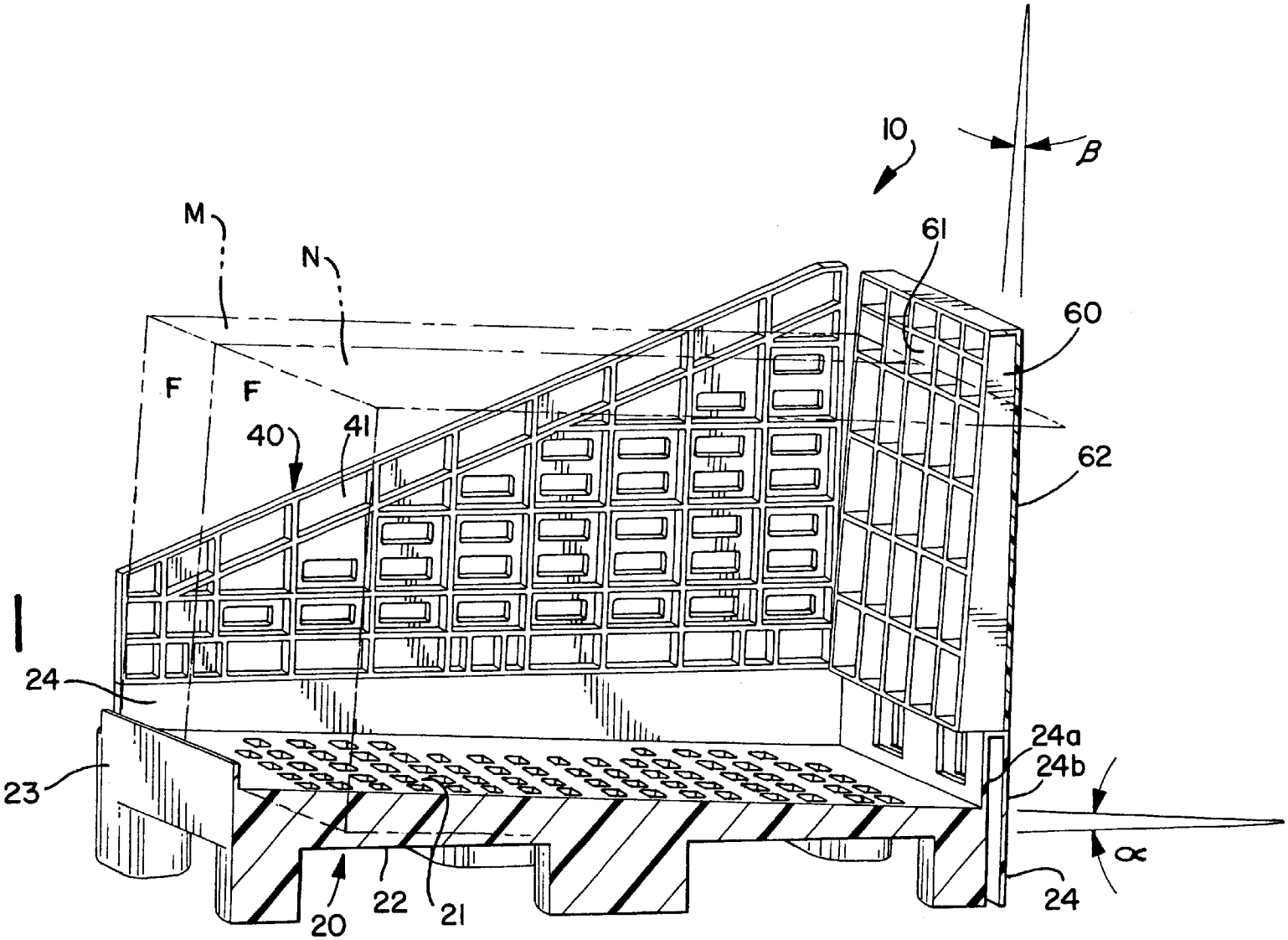
FIG. 11 is identical to the drawing of FIG. 3 with the addition of two boxes supported thereon.

Thus, when the container 10 is in the assembled (open) position (see FIG. 1), rectangular (relatively narrow) boxes [Boxes M and N], such as those for door mirrors, windows, glass panes, frames, and the like can be stored on the base 20, between the walls 50 against the rear wall 60, as shown in FIG. 11. The boxes are stored neither on their front or back faces S, nor on top of one another; rather, they are transported and stored side-by-side and on their side edges, again much like books on a shelf with their front side edges F facing outwardly. The slope of the top surface of the base 20 (approximately 2.5°) causes the items stored to tilt towards the rear wall 60 where their load can be partially supported by the rear wall 60. In addition, this reduces the chance of the damage to the contents of the boxes and the chance of them falling off the container 10. The boxes are nicely displaced with their faces F exposed.

The preferred slope of 2.5° is used because it is sufficient to shift part of the load to the rear wall 60, yet maintain the items (boxed or un-boxed) within the dimensional limitations of the container 10. Naturally, a range of slopes are contemplated which will sufficiently achieve the goals of the present invention. For smaller items a base surface slope of up to about 10° or more may be used. Larger items may require only a slight slope of maybe 1°.

Additionally, a front lip 23 projects from the base 20 and prevents the boxes from sliding from the container 10. To remove an item [box], it is necessary to lift the item above the lip 23 and slides it forward off the container 10.

Figure 12:
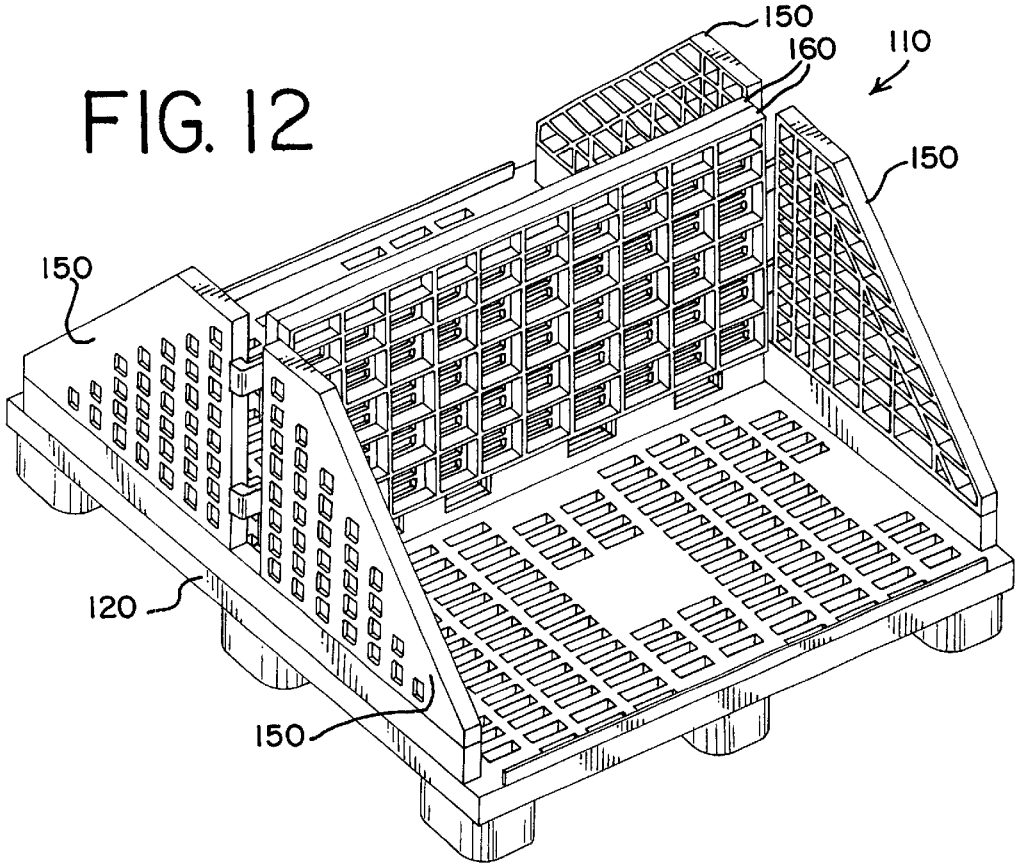
FIG. 12 is a top perspective view of another embodiment of a container made in accordance with the teachings of the present invention.
Figure 13:
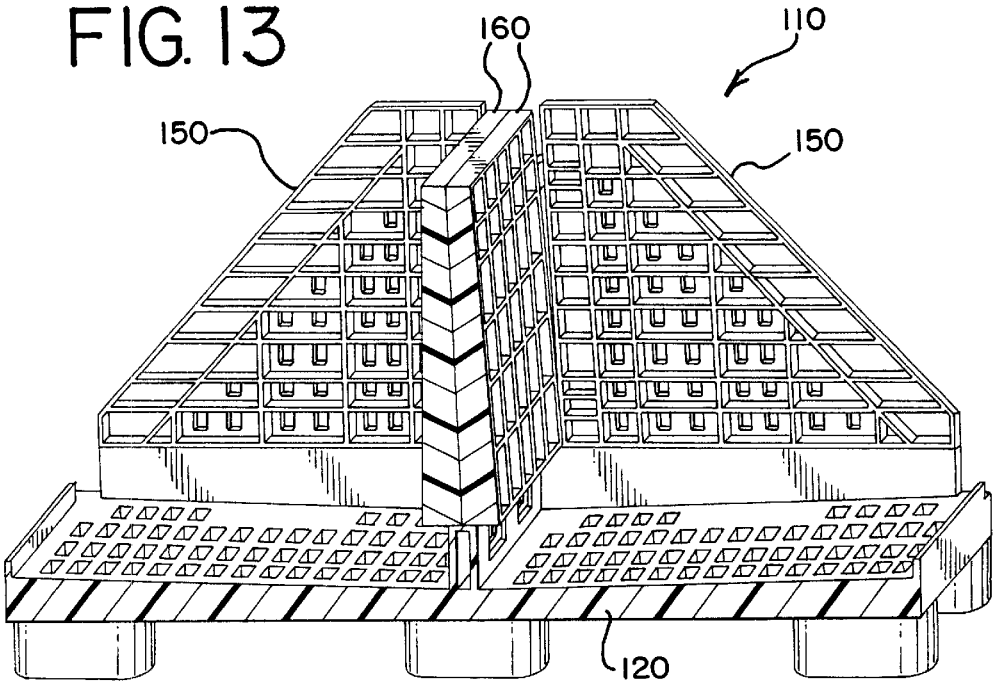
FIG. 13 is a sectional side perspective view of the embodiment shown in FIG. 12.

An alternative embodiment, shown in FIGS. 12 and 13, utilizes a double-sloped base 120, two center wall panels 160, and four collapsible side walls 150. The center wall panels 160 divide the upper surface of the base 120 into two approximately equal areas—though the base 120 may be disproportionately divided if desired. The side walls 150 complete a three-sided enclosure of the area two areas.

FIG. 13 illustrates an approximately 2.5° slope of the left and right areas of the upper surface of the base 120 toward the center panel 160. The two center wall panels 160 are configured to abut one another along their inner surfaces. Further, each outer surface of the center wall panels 160 is sloped to match the slope of the adjacent sloped upper surface area of the base 120 (i.e., the adjacent surfaces of the base and center panels are perpendicular to one another). Hinge assemblies between the side panels and base and connectors between adjacent side panels and center wall panels are contemplated for this embodiment as well. Such features would be substantially identical to those previously discussed for the single-sloped base container 10.

The double-slopped embodiment permits compaction of the container 110 when empty by folding down each of the center wall panels 160 to form a flat upper surface. By matching the slopes between adjacent surfaces, the result of laying one surface (e.g., the center wall panel 160) atop the other (e.g., the base 120) is to negate the sloped surface leaving a level upper surface. This allows the side walls 150 to be compacted upon the level surface as well.

Another alternative embodiment (not shown) is identical to the single and double sloped embodiments discussed above, without sidewalls. The sidewalls provide lateral support to both the rear wall and the center wall, and help retain any items on the base. However, with large items, side egress from the base (either embodiment) can be prevented by use of a small upward stop. Lateral support can be improved with the rear wall and center wall by the hinge connectors or by creating a single piece construction. Other means for improving the lateral stability of the rear and center wall are known to those skilled in the art.

Each of the disclosed embodiments above is discussed as having a preferable modular design. That is, the side walls, rear walls, center wall panels, base, etc. are separately manufactured components which can be fitted together, as discussed. However, while presenting some economic disadvantages, each embodiment could be a single unitary design. Those skilled in the art of plastic molding processes could readily prepare such a unitary design from the discussion and drawings of this application.

While the specific embodiments have been illustrated and described, numerous modifications come to mind without significantly departing from the spirit of the invention and the scope of protection is only limited by the scope of the accompanying claim.

We claim:

1. A container for packing substantially flat articles along an edge comprising:

a pallet base adapted to be transported by tines of a lift and having an upper surface supported above the ground; and a rear wall connected to the base and having an inner surface and two side edges, wherein the upper surface is sloped downwardly toward the inner surface of the rear wall.

2. The container of claim 1, further comprising opposed side walls attached to the base adjacent each side edge of the rear wall.

3. The container of claim 2, wherein the opposed side walls are pivotably connected to the base.

4. The container of claim 3, wherein each of the opposed side walls has at least one "T" shaped male hinge component and the base has a correspondingly aligned female hinge component.

5. The container of claim 4, wherein each of the opposed side walls has two male hinge components and the base has a correspondingly aligned female hinge component for each male component on each side wall.

6. The container of claim 4, wherein the rear wall has two male hinge components and the base has a correspondingly aligned female hinge component for each male component.

7. The container of claim 3, wherein the rear wall has at least one "T" shaped male hinge component and the base has a correspondingly aligned female hinge component.

8. The container of claim 2, further comprising interlocking connectors between the side walls and the rear wall.

9. The container of claim 8, wherein the side walls and rear wall are capable of being folded flat against the base, and the interlocking connectors of the side walls and the rear wall engage the upper surface of the base when folded flat.

10. The container of claim 2, wherein the base, sidewalls and rear wall are unitary.

11. The container of claim 1, wherein the base and rear wall are unitary.

12. The container of claim 1, wherein the angle of the slope of the upper surface is within the range of from about 1° to about 10°.

13. The container of claim 3, wherein the angle of the slope of the upper surface is about 2.5°.

14. The container of claim 1, wherein the inner surface of the rear wall is sloped toward an area above the base.

15. The container of claim 14, wherein the angle of the slope of the inner surface is within the range of from about 1° to about 10°.

16. The container of claim 15, wherein the angle of the slope of the inner surface is about 2.5°.

17. The container of claim 14, wherein the inner surface is sloped to be perpendicular to the upper surface of the base.

18. The container of claim 1, wherein the rear wall is pivotably connected to the base.

19. A container for packing substantially flat articles along an edge comprising:

a pallet base adapted to be transported by tines of a lift and having an upper surface supported above the ground; and at least one center wall panel having outer surfaces and connected to and dividing into two areas the upper surface of the base, wherein the two areas of the upper surface of the base are sloped downwardly toward the center wall panel.

20. The container of claim 19, further comprising a plurality of side walls connected to the base.

21. The container of claim 20, wherein the plurality of side walls comprises two pair of opposed side walls.

22. The container of claim 20, wherein the side walls are pivotably connected to the base.

23. The container of claim 22, wherein each of the side walls has at least one "T" shaped male hinge component and the base has a correspondingly aligned female hinge component.

24. The container of claim 23, wherein each of the side walls has two male hinge components and the base has a correspondingly aligned female hinge component for each male component on each side wall.

25. The container of claim 19, wherein the center wall panel is pivotably connected to the base.

26. The container of claim 25, wherein the center wall panel has at least one "T" shaped male hinge component and the base has a correspondingly aligned female hinge component.

27. The container of claim 26, wherein the center wall panel has two male hinge components and the base has a correspondingly aligned female hinge component for each male component.

28. The container of claim 20, further comprising interlocking connectors between the side walls and the center wall panel.

29. The container of claim 28, wherein the side walls and center wall panel are capable of being folded flat against the base, and the interlocking connectors of the side walls and the center wall panel engage the upper surface of the base when folded flat.

30. The container of claim 19, wherein the angles of the sloped areas of the upper surface are within the range of from about 1° to about 10°.

31. The container of claim 19, wherein the angles of the sloped areas of the upper surface are identical.

32. The container of claim 31, wherein the angles of the sloped areas of the upper surface are each about 2.5°.

33. The container of claim 20, wherein the outer surfaces are sloped to be perpendicular to a sloped area of the upper surface of the base.

34. A container for packing substantially flat articles along an edge comprising:

a base having an upper surface; and at least two center wall panels abutting one another along an inner surface of each and having outer surfaces and connected to and dividing into two areas the upper surface of the base, wherein the two areas of the upper surface of the base are sloped downwardly toward the center wall panel.

35. The container of claim 34, wherein each of the two center wall panels is sloped along the outer surface outwardly down the panels.

36. The container of claim 35, wherein the angles of the sloped outer surfaces are within the range of from about 1° to about 10°.

37. The container of claim 36, wherein the angles of the sloped outer surfaces are identical.

38. The container of claim 37, wherein the angles of the sloped outer surfaces are about 2.5°.

39. The container of claim 35, wherein the outer surfaces are sloped to be perpendicular to a sloped area of the upper surface of the base.

40. A container for packing substantially flat articles along an edge comprising:

a base having an upper surface; and at least one center wall panel having outer surfaces and connected to and dividing into two areas the upper surface of the base, wherein the two areas of the upper surface of the base are sloped downwardly toward the center wall panel and the outer surfaces of the center wall panel are sloped outwardly down the panel surfaces.

41. The container of claim 40, wherein the angles of the sloped outer surfaces are within the range of from about 1° to about 10°.

42. The container of claim 41, wherein the angles of the sloped outer surfaces are identical.

43. The container of claim 42, wherein the angles of the sloped outer surfaces are about 2.5°.

44. A container for packing substantially flat articles along an edge comprising:

a pallet base adapted to be transported by tines of a lift and having non-parallel lower and upper surfaces; and a rear wall connected to the base having non-parallel inner and outer surfaces, the upper surface being sloped downwardly toward the inner surface of the rear wall such that the rear wall and upper surface are generally perpendicular to one another.

* * * * *